US011412602B2

(12) United States Patent
Van De Sluis et al.

(10) Patent No.: US 11,412,602 B2
(45) Date of Patent: Aug. 9, 2022

(54) RECEIVING LIGHT SETTINGS OF LIGHT DEVICES IDENTIFIED FROM A CAPTURED IMAGE

(71) Applicant: SIGNIFY HOLDING B.V., Eindhoven (NL)

(72) Inventors: Bartel Marinus Van De Sluis, Eindhoven (NL); Marius Leendert Trouwborst, Den Bosch (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/311,815

(22) PCT Filed: Jan. 8, 2020

(86) PCT No.: PCT/EP2020/050252
§ 371 (c)(1),
(2) Date: Jun. 8, 2021

(87) PCT Pub. No.: WO2020/148117
PCT Pub. Date: Jul. 23, 2020

(65) Prior Publication Data

US 2022/0022305 A1 Jan. 20, 2022

(30) Foreign Application Priority Data

Jan. 14, 2019 (EP) ..... 19151619

(51) Int. Cl.
*H05B 47/155* (2020.01)

(52) U.S. Cl.
CPC ..... *H05B 47/155* (2020.01)

(58) Field of Classification Search
CPC .. H05B 47/155; H05B 47/125; H05B 47/105; H05B 47/19; G06F 16/48; Y02B 20/40; H04N 21/816; H04N 2013/403
See application file for complete search history.

(56) References Cited

U.S. PATENT DOCUMENTS

| | | | |
|---|---|---|---|
| 9,041,296 B2 | 5/2015 | Yianni et al. | |
| 9,501,718 B1 | 11/2016 | Sarnaik | |
| 9,769,910 B2 | 9/2017 | Aliakseyeu et al. | |
| 10,653,951 B2 * | 5/2020 | Aliakseyeu | A63F 13/212 |
| 2012/0173382 A1 | 7/2012 | Loveland | |

(Continued)

FOREIGN PATENT DOCUMENTS

| | | |
|---|---|---|
| WO | 2017084904 A1 | 5/2017 |
| WO | 2018050590 A1 | 3/2018 |

*Primary Examiner* — Haissa Philogene

(57) ABSTRACT

An electronic device (1) is configured to obtain at least one image (81) captured with a camera. The at least one image captures one or more light effects (91,92). The electronic device is further configured to perform image analysis on the at least one image to identify one or more lighting devices (25,26) rendering the one or more light effects, receive one or more input signals comprising one or more current light settings of the identified one or more lighting devices, and output the one or more current light settings and an association between the one or more current light settings and the at least one image. A user of another device may be able to activate these one or more light settings on one or more of his own lighting devices by selecting the at least one image.

14 Claims, 5 Drawing Sheets

(56) References Cited

U.S. PATENT DOCUMENTS

| | | | | |
|---|---|---|---|---|
| 2015/0351204 | A1* | 12/2015 | Hershberg | G08C 23/02 315/153 |
| 2018/0284953 | A1 | 10/2018 | Brunault et al. | |
| 2018/0314412 | A1 | 11/2018 | Nakauchi et al. | |
| 2020/0167846 | A1* | 5/2020 | Aliakseyeu | G06N 5/04 |
| 2020/0358629 | A1* | 11/2020 | Panec | H04L 51/18 |
| 2020/0413520 | A1* | 12/2020 | Aliakseyeu | H05B 47/115 |

* cited by examiner

RECEIVING LIGHT SETTINGS OF LIGHT DEVICES IDENTIFIED FROM A CAPTURED IMAGE

CROSS-REFERENCE TO PRIOR APPLICATIONS

This application is the U.S. National Phase application under 35 U.S.C. § 371 of International Application No. PCT/EP2020/050252, filed on Jan. 8, 2020, which claims the benefit of European Patent Application No. 19151619.4, filed on Jan. 14, 2019. These applications are hereby incorporated by reference herein.

FIELD OF THE INVENTION

The invention relates to an electronic device for outputting one or more light settings and an association between said one or more light settings and at least one image.

The invention further relates to a method of outputting one or more light settings and an association between said one or more light settings and at least one image.

The invention also relates to a computer program product enabling a computer system to perform such a method.

BACKGROUND OF THE INVENTION

The multitude of colors offered by LED lighting has made functionality that allows a user to define different light scenes for different moments beneficial. Connected lighting typically not only allows a user to select a scene with his mobile device, but also to control multiple lamps in a single scene. An example of such connected lighting is the Philips Hue system.

US 20180314412 A1 discloses an illumination system including: luminaires; an illumination controller that controls lighting of the luminaires; and an operation terminal that communicates with the illumination controller. A camera of the operation terminal captures at least one luminaire in an image, and a touch panel of the operation terminal displays the image including the at least one luminaire. Identification information of the at least one luminaire is obtained based on the image and a control parameter of the luminaire can be set.

Scenes can typically be recalled manually by selecting a name of a scene, although systems that recall scenes automatically are also known. For example, U.S. Pat. No. 9,041,296 B2 discloses a controller for a lighting arrangement, wherein the controller comprises a detector unit arranged to provide parameters related to identifiable beacons within a field of view of the detector unit. The controller further comprises a processing unit that is arranged to control the lighting arrangement in accordance with a set of lighting parameters associated with the parameters provided by the detector unit. In an embodiment, the controller records defining features in its field of view (e.g. as an image) in a memory unit of the controller and associates them with a scene comprising lighting parameters so that the scene can be recalled automatically.

If a user wants to use a light scene created by another user, then automatically recalling a light scene may not be possible or desirable. Connected lighting systems enable users to store and share light scenes, but storing and sharing light scenes is not always easy, because it may require the user to repeatedly adapt and activate the light scene. This is especially not easy if a light scene needs to control multiple lamps with different settings. Furthermore, storing, sharing and choosing from a large variety of light scenes requires good light scene representations and giving a good representative name to a light scene is not trivial.

SUMMARY OF THE INVENTION

It is a first object of the invention to provide an electronic device, which can be used to easily store and share light settings.

It is a second object of the invention to provide a method, which can be used to easily store and share light settings.

In a first aspect of the invention, an electronic device for outputting one or more light settings and an association between said one or more light settings and at least one image comprises at least one input interface, at least one output interface, and at least one processor configured to use said at least one input interface to obtain at least one image captured with a camera, said at least one image capturing one or more light effects, identify one or more lighting devices which render said one or more light effects, use said at least one input interface to receive one or more input signals comprising one or more current light settings of said identified one or more lighting devices, and use said at least one output interface to output said one or more current light settings and an association between said one or more current light settings and said at least one image.

By obtaining the current light settings from the one or lighting devices identified from the image, the user does not need to repeatedly adapt and activate the light scene. When the user sees light settings that he likes, e.g. created by himself, another user or an application, he can simply take a picture with his camera to obtain the current light settings of the relevant lighting devices. The same image is then associated with the current light settings to create a proper light scene representation that makes it easier to recall the light settings. As a result, the user may be able to skip naming the light scene or the need for a good representative name at least becomes less important. Thus, the storing and sharing of light settings becomes quite easy.

Said at least one processor may be configured to identify said one or more lighting devices by performing image analysis on said at least one image. For example, said at least one processor may be configured to identify at least one of said one or more lighting devices by detecting one or more codes in said rendered one or more light effects and/or by recognizing said at least one of said one or more lighting devices in said at least one image using object recognition and/or by recognizing at least one of said one or more light effects in said at least one image using image analysis. Said electronic device may be part of a lighting system which further comprises one or more lighting devices.

Alternatively or additionally, said at least one processor may be configured to identify said one or more lighting devices by identifying at least one lighting device in a field of view said camera and/or at least one light effect in said field of view of said camera based on a spatial location and an orientation of said camera and at least one spatial location of said at least one lighting device and/or of at least one further lighting device rendering said at least one light effect. If the camera is incorporated into a mobile device, the spatial location and orientation of the mobile device may be used as spatial location and orientation of the camera. Spatial locations of lighting devices may be received via wireless signals, for example. These wireless signals may also indicate whether a lighting device is currently rendering light. A lighting device is preferably only identified as contributing to said one or more light effects if it is known to be currently rendering light.

Said at least one processor may be configured to use said at least one input interface to obtain said association, said one or more light settings, and said at least one image, use said at least one output interface to control a display to display said at least one image, use said at least one input interface to allow a user to select said at least one image, and use said at least one output interface to control at least one lighting device to render light according to said one or more light settings upon said selection. This allows the light settings stored on the electronic device to be recalled on the same electronic device, with the help of the image representative of the light settings (i.e. light scene). In the case that the light settings have a light setting name (e.g. Relax, Activate, Sunset) associated with it, the light setting name may be rendered together with the image in order to achieve a more complete and memorable representation of the light settings. In the case of a video capturing the light effects of multiple light settings changing over time, the corresponding light setting names only appear when active.

Said at least one processor may be configured to use said at least one output interface to transmit a light setting signal which comprises said one or more current light settings and said association. By transmitting the light settings to another device, e.g. a server or a user device, the light settings can be shared with other users.

Said one or more light effects may comprise at least one dynamic light effect. Dynamic light effects may enhance the mood created by the light. If settings of one or more dynamic light effects are to be output, then said one or more input signals may further comprise one or more previous light settings and/or one or more future light settings and said association may associate said one or more previous light settings and/or said one or more future light settings with said at least one image.

Said at least one image may comprise a plurality of images. A video typically captures dynamic light effects better than a single image.

Said at least one processor may be configured to select said plurality of images from a captured video, a frame of said captured video being included in said plurality of images based on a level of changes between light settings captured in said frame and light settings captured in a preceding frame of said captured video. Thereby, a relative short video that still captures (important) changes in light settings may be created.

Said association may associate at least one of said one or more light settings with a subset of said plurality of images. If a video comprises images that do not represent the one or more light settings well, it is beneficial to associate the one or more light settings with a subset of the video frames. Different sets of one or more light settings may be associated with different parts of a video. For example, when a user clicks a video at a first moment, a first set of one or more light settings may be selected, and when a user clicks the video at a second moment, a second set of one or more light settings may be selected.

Said at least one processor may be configured to output said one or more light settings as metadata of said at least one image and/or said at least one processor is configured to output said at least one image as metadata of said one or more light settings. This allows the light settings and the at least one image to be stored and shared conveniently in the same file.

In a second aspect of the invention, a system comprises said electronic device and a further electronic device. Said further electronic device comprises at least one input interface, at least one output interface, and at least one processor configured to use said at least one input interface to receive a light setting signal which comprises one or more light settings and an association between said one or more current light settings and at least one image, use said at least one output interface to control a display to display said at least one image, use said at least one input interface to allow a user to select said at least one image, and use said at least one output interface to control at least one lighting device to render light according to said one or more light settings upon said selection.

Thus, a user of the further electronic device is able to recall the light settings stored on the electronic device and shared by a user of the electronic device. The user of the electronic device and the user of the further electronic device may be different users of the same connected home or building management system, for example. Alternatively, the electronic device and the further electronic device may be connected through some form of social network, for example.

In a third aspect of the invention, a method of outputting one or more light settings and an association between said one or more light settings and at least one image comprises obtaining at least one image captured with a camera, said at least one image capturing one or more light effects, identify one or more lighting devices which render said one or more light effects, receiving one or more input signals comprising one or more current light settings of said identified one or more lighting devices, and outputting said one or more current light settings and an association between said one or more current light settings and said at least one image. Said method may be performed by software running on a programmable device. This software may be provided as a computer program product.

Said method may further comprise obtaining said association, said one or more light settings, and said at least one image, controlling a display to display said at least one image, allowing a user to select said at least one image, and controlling at least one lighting device to render light according to said one or more light settings upon said selection.

Moreover, a computer program for carrying out the methods described herein, as well as a non-transitory computer readable storage-medium storing the computer program are provided. A computer program may, for example, be downloaded by or uploaded to an existing device or be stored upon manufacturing of these systems.

A non-transitory computer-readable storage medium stores at least one software code portion, the software code portion, when executed or processed by a computer, being configured to perform executable operations for outputting one or more light settings and an association between said one or more light settings and at least one image.

The executable operations comprise obtaining at least one image captured with a camera, said at least one image capturing one or more light effects, identifying one or more lighting devices which render said one or more light effects, receiving one or more input signals comprising one or more current light settings of said identified one or more lighting devices, and outputting said one or more current light settings and an association between said one or more current light settings and said at least one image.

As will be appreciated by one skilled in the art, aspects of the present invention may be embodied as a device, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

BRIEF DESCRIPTION OF THE DRAWINGS

These and other aspects of the invention are apparent from and will be further elucidated, by way of example, with reference to the drawings, in which.

Corresponding elements in the drawings are denoted by the same reference numeral.

DETAILED DESCRIPTION OF THE EMBODIMENTS

Figure 1:
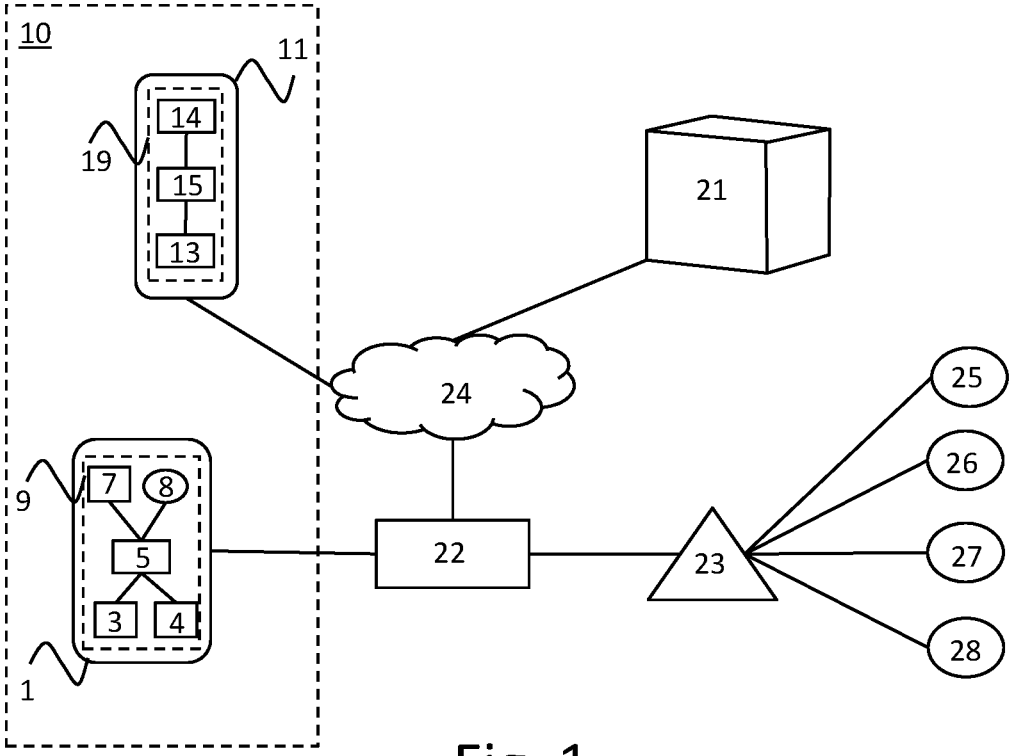
FIG. 1 is a block diagram of a first embodiment of the electronic device.

FIG. 1 shows a first embodiment of the electronic device for outputting one or more light settings: mobile device 1. The mobile device 1 is connected to a wireless LAN access point 22. A bridge 23, e.g. a Philips Hue bridge, is also connected to the wireless LAN access point 22, e.g. via Ethernet. In the embodiment of FIG. 1, the bridge 23 communicates with the lighting devices 25-28 using Zigbee technology. The bridge 23 and the lighting devices 25 to 28 are part of a Zigbee network. The lighting devices 25-28 may be Philips Hue lights, for example. The wireless LAN access point 22 is connected to Internet (backbone) 24.

The mobile device 1 comprises a receiver 3, a transmitter 4, a processor 5, a memory 7, a camera 8 and a touchscreen display 9. The processor 5 is configured to use an interface to the camera 8 to obtain at least one image captured with the camera 8. The at least one image captures one or more light effects. The processor 5 is further configured to identify one or more lighting devices which render the one or more light effects, e.g. one or more of lighting devices 25-28.

The processor 5 is also configured to use the receiver 3 to receive one or more input signals comprising one or more current light settings of the identified one or more lighting devices from these lighting devices or from the bridge 23 and use transmitter 4 and an interface to memory 7 to output the one or more current light settings and an association between the one or more current light settings and the at least one image.

In the embodiment of FIG. 1, the processor 5 is configured to store the one or more current light settings and the association in the memory 7 and use the transmitter 4 to transmit a light setting signal, which comprises the one or more current light settings and the association, to a server 21. In an alternative embodiment, the processor 5 does not store the one or more current light settings and the association in the memory 7 and only transmits a light setting signal to another device, e.g. server 21.

The at least one image captured with the camera 8 may comprise a plurality of images. The one or more light effects may comprise at least one dynamic light effect, for example. In addition to one or more current light settings, the one or more input signals may further comprise one or more previous light settings and/or one or more future light settings. The created association may then associate these one or more previous light settings and/or these one or more future light settings with the at least one image as well.

The at least one processor may be further configured to process the at least one image. The processor may, for example, adjust the image based on the one or more light effects in the image. The image may for example be processed to compensate under-represented colors (e.g. by applying an image color adjustment). Additionally or alternatively, the processor may be configured to obtain information indicative of the light spectrum and/or the light intensity of the light effects (e.g. from the lighting devices, or by analyzing the image), and the processor may adjust the image based on this information. The processor may perform this to, for example, enhance the image. The processor may be configured to change the light effects in the image based on the colors of the light effects in the image. The processor may be configured to output an association between the changed light settings (which are based on the changed light effects) and said at least one image. This is beneficial, because a single image may be used for and associated with multiple light settings. The processor may, for example, output a first association between a first (captured) version image and the current light settings, and a second association between a second (adjusted) version of the image and the adjusted light settings.

In the embodiment of FIG. 1, a user of the mobile device 1 is able to recall the one or more light settings stored in the memory 7 or the one or more light settings stored on the server 21 at a later time. For this reason, the processor 5 is configured to use an interface to the memory 7 or the receiver 3 to obtain the association, the one or more light settings, and the at least one image from the memory 7 or the server 21, respectively. The processor 5 is further configured to use an interface to the display 9 to control the display 9 to display the at least one image, use the (touchscreen) display 9 to allow a user to select the at least one image. The processor 5 is also configured to use the transmitter 4 to control at least one of lighting devices 25-28 via the bridge 23 to render light according to the one or more light settings upon the selection.

In the embodiment of FIG. 1, a user of a mobile device 11, which comprises a receiver 13, a transmitter 14, a processor 15 and a touchscreen display 19, is also able to recall the one or more light settings stored on the server 21. For this reason, the processor 15 is configured to use the receiver 13 to receive a light setting signal which comprises one or more light settings and an association between the one or more current light settings and at least one image. The processor 15 is further configured to use an interface to the display 19 to control the display 19 to display the at least one image, use the (touchscreen) display 19 to allow a user to select the at least one image, and use the transmitter 14 to control at least one lighting device (typically at least one lighting device other than lighting devices 25-28) to render light according to the one or more light settings upon the selection. The mobile devices 1 and 11 form a system 10.

The capturing of the at least one image is typically initiated by a user, but may also be initiated automatically, e.g. when a change in light settings is detected. The image capturing mode may depend on the type of light scene or type of light setting change. For instance, in the case of a static light scene, a single picture may be taken while in the case of a dynamic light scene, a video recording may be made for the duration of the dynamic light scene. Optionally, frames are only captured if significant light setting changes occur, enabling time-lapse recordings of lengthy, slow-changing dynamic light scenes.

In the embodiment of FIG. 1, it is the camera 8 of the mobile device 1 that captures the at least one image. In an alternative embodiment, a user specifies a light setting capturing camera (for an area. e.g. per room) which is optimally suited for capturing the light effects in the area. For instance, a stationary camera such as a smartTV camera or a surveillance positioned in a corner of the room. It is this camera that captures the at least one image. The user may still use the lighting control app on his mobile device to activate "light scene capturing", but the image capturing will be done by the assigned stationary camera.

In the embodiment of the mobile device 1 shown in FIG. 1, the mobile device 1 comprises one processor 5. In an alternative embodiment, the mobile device 1 comprises multiple processors. The processor 5 of the mobile device 1 may be a general-purpose processor, e.g. from ARM or Qualcomm or an application-specific processor. The processor 5 of the mobile device 1 may run an Android or iOS operating system for example. The memory 7 may comprise one or more memory units. The memory 7 may comprise solid state memory, for example. The camera 8 may comprise a CMOS or CCD sensor, for example. The display 9 may comprise an LCD or OLED display panel, for example.

In the embodiment shown in FIG. 1, the mobile device 1 comprises a separate receiver 3 and transmitter 4. In an alternative embodiment, the receiver 3 and transmitter 4 have been combined into a transceiver. In this alternative embodiment or in a different alternative embodiment, multiple receivers and/or multiple transmitters are used. The receiver 3 and transmitter 4 may use one or more wireless communication technologies to communicate with the wireless access point 12, e.g. Wi-Fi. The mobile device 1 may comprise other components typical for a mobile device such as a battery and a power connector. The invention may be implemented using a computer program running on one or more processors.

Figure 2:
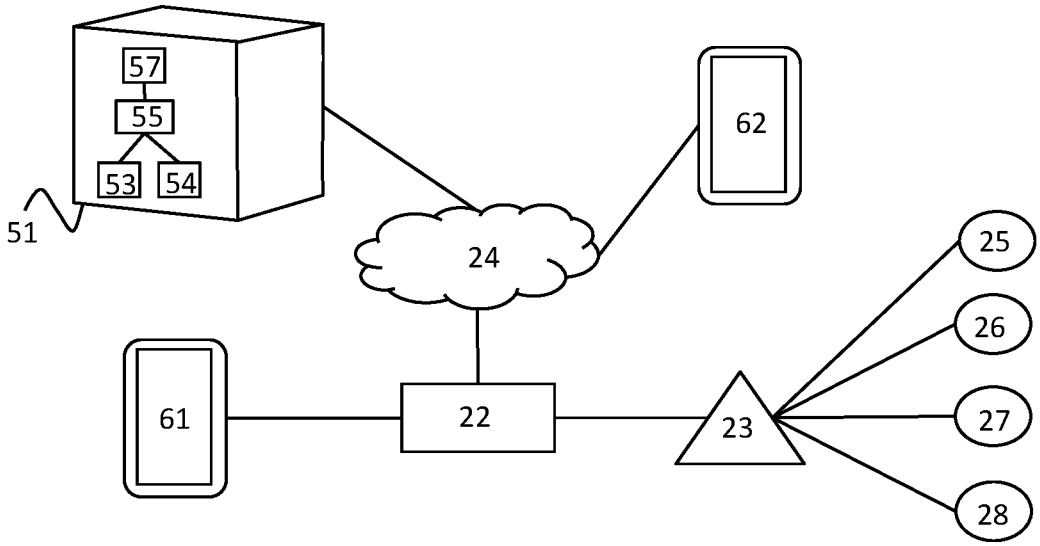
FIG. 2 is a block diagram of a second embodiment of the electronic device.

FIG. 2 shows a second embodiment of the electronic device for determining a reachability of a further electronic device over a wireless connection system: a server 51. The server 51 comprises a receiver 53, a transmitter 54, processor 55, and a memory 57. The processor 55 is configured to use the at least one input interface to obtain at least one image captured with a camera, e.g. of a mobile device 61. The at least one image captures one or more light effects. The processor 55 is further configured to identify one or more lighting devices which render the one or more light effects, e.g. one or more of lighting devices 25-28.

The processor 55 is also configured to use the receiver 53 to receive one or more input signals comprising one or more current light settings of the identified one or more lighting devices from these lighting devices and use an interface to the memory 57 to output the one or more current light settings and an association between the one or more current light settings and the at least one image. The server 53 may receive the one or more input signals from the bridge 23 or from another Internet server (not depicted) to which the bridge 23 transmits light settings of lighting devices 25-28, for example.

The at least one image is later displayed on a display of the mobile device 61 and/or on a display of a mobile device 62 and selecting of the at least one image activates the associated one or more light settings.

In the embodiment of the server 51 shown in FIG. 2, the server 51 comprises one processor 55. In an alternative embodiment, the server 51 comprises multiple processors. The processor 55 of the server 51 may be a general-purpose processor, e.g. from Intel or AMD, or an application-specific processor. The processor 55 of the server 51 may run a Windows or Unix-based operating system for example. The memory 57 may comprise one or more memory units. The memory 57 may comprise one or more hard disks and/or solid-state memory, for example. The memory 57 may be used to store an operating system, applications and application data (e.g. light settings and images), for example.

The receiver 53 and transmitter 54 may use one or more wired and/or wireless communication technologies to communicate with other systems in a local area network or over the Internet, for example. In the embodiment shown in FIG. 2, the server 51 comprises a separate receiver 53 and transmitter 54. In an alternative embodiment, the receiver 53 and transmitter 54 have been combined into a transceiver. In this alternative embodiment or in a different alternative embodiment, multiple receivers and/or multiple transmitters are used. The server 51 may comprise other components typical for a server such as a power connector. The invention may be implemented using a computer program running on one or more processors.

In the embodiment of FIGS. 1 and 2, a bridge is used to control lighting devices 15-18. In an alternative embodiment, lighting devices 15-18 are controlled without using a bridge.

Figure 3:
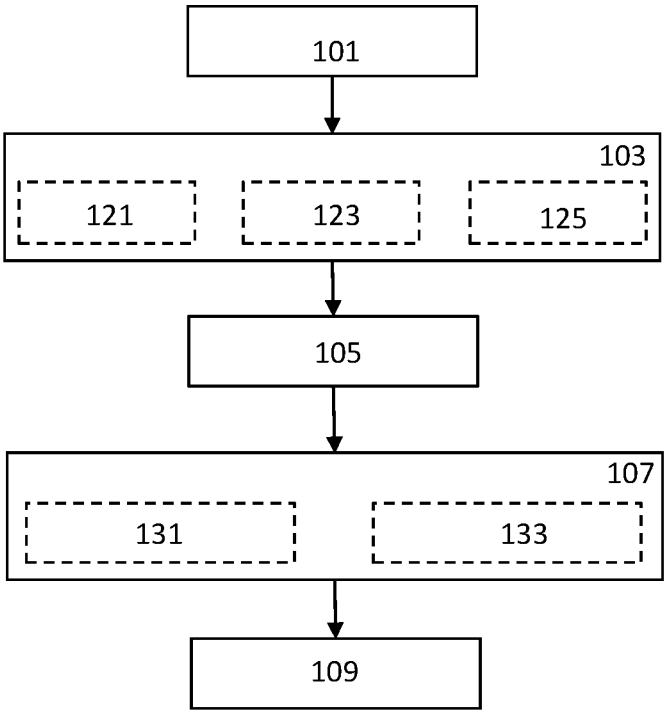
FIG. 3 is a flow diagram of a first embodiment of the method.

A first embodiment of the method of outputting one or more light settings is shown in FIG. 3. In this first embodiment, a step 101 comprises obtaining at least one image captured with a camera. The at least one image captures one or more light effects. Typically, the method is run on a smart device which itself has (1) access to light settings of controllable lighting devices and has (2) a camera to capture images of the area. For instance, the camera app on the smart device detects that an image or video is being captured while a particular light scene is active or prominently visible in the captured image content. The camera app may then query the lighting control app in order to get more information about the current light scene.

Alternatively, the lighting control app has an integrated camera function which automatically captures an image or video once a light scene gets activate, or simply provides the camera functionality to a user making it easy to capture an image or video or a rendered light scene. An advantage of this approach is that no inter-app communication is needed between a lighting app and a camera app, and that the camera function as part of the lighting app can be adjusted that current light settings and light setting changes are automatically added to the captured image content.

A step 103 comprises performing image analysis on the at least one image to identify one or more lighting devices rendering the one or more light effects. Step 103 may comprise one or more of sub steps 121, 123 and 125. Step 121 comprises identifying at least one of the one or more lighting devices by detecting one or more (Visible Light Communication/VLC) codes in the rendered one or more light effects. Step 123 comprises identifying at least one of the one or more lighting devices by recognizing the at least one of the one or more lighting devices (e.g. their shape) in the at least one image using object recognition.

In an alternative embodiment, instead of or in addition to performing image analysis to identify the one or more lighting devices, the position/orientation of the camera is determined and based on this, co-located lighting devices (active during the image capturing) are determined. The co-located lighting devices should be located in the field of view of the camera and/or render a light effect in the field of view of the camera. The orientation of the camera may be determined using an orientation sensor, for example. The positions of the camera and co-located lighting devices may be determined using RF beacons, for example.

Step 125 comprises identifying at least one of the one or more lighting devices by recognizing at least one of the one or more light effects (e.g. their shape) in the at least one image using image analysis (e.g. object recognition). VLC codes, light device object models (e.g. shapes) and/or light effect object models (e.g. shapes) may be associated with identifiers of lighting devices in a bridge or on a server (in relation to a certain user or lighting system), for example.

A step 105 comprises receiving one or more input signals comprising one or more current light settings of the identified one or more lighting devices. These current light settings are retrieved based on the lighting device identifier(s) (e.g. "Hue WhiteAmbience lamp 1"). The light settings can be retrieved from a lighting controller device, which may be integrated in the lighting device or in a separate lighting control device (e.g. a bridge), for example.

The retrieved light settings may optionally include previous and next light settings. The way light settings are retrieved may depend on the type of image content being captured. For instance, for a single picture only the light settings at the capture moment may be retrieved, while when a video is being captured, all (dynamic) light settings and scene changes during the duration of the video may be retrieved.

A step 107 comprises making an association between the one or more current light settings and the at least one image. Step 107 may comprise one or more of sub steps 131 and 133. Step 131 comprises including the one or more light settings in metadata of the at least one image. For instance, this makes it possible when storing or sharing the image with others that the image can be used to activate the stored light settings on the same or on other lighting devices. For instance, a person receiving an image of a nice sunset light scene can click the image to activate the associated light settings on his own lighting infrastructure.

Step 133 comprises including the at least one image in metadata of the one or more light settings. For instance, if the lighting control app features a camera function, upon storing a new light setting the lighting app may prompt the user to "make a picture of your new light scene". A compact version (thumbnail) of the resulting image can then be used as a scene icon.

The association between light setting(s) and image content may also comprise spatial or temporal specifics. For instance, if it is known where a lighting device is visible in the image, the retrieved light settings may be associated to specific image coordinates or image segment. In the case of a video capturing multiple light scenes or a dynamic light scene, the associated light settings may be coupled to corresponding time positions of the video.

A step 109 comprises outputting the association and the one or more current light settings, e.g. the one or more current light setting and its metadata or the at least one image and its metadata.

The main purpose of steps 101-109 is that the resulting at least one image (associated with light settings) can be used as a graphical representation for the light settings, either for inspiration and sharing, or for light setting activation ("light scene icon"). This can be used by the user himself, or by others if the image content is sent or shared over a network (e.g. someone shares a video "look I have programmed a great sunset light scene". The video may feature two play buttons: "play video", and "play scene on my Hue system"). It may be possible for the user who has sent the image content to see whether the receiving user has activated the video and/or has activated the associated light scene on his own lighting system.

Figure 4:
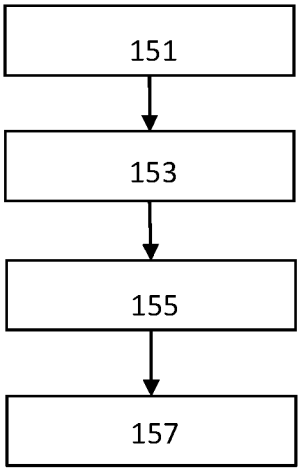
FIG. 4 is a flow diagram of a second embodiment of the method.

A second embodiment of the method is shown in FIG. 4. A step 151 comprises obtaining the association, the one or more light settings, and the at least one image. A step 153 comprises controlling a display to display the at least one image. A step 155 comprises allowing a user to select the at least one image. A step 157 comprises controlling at least one lighting device to render light according to the one or more light settings upon the selection. Steps 151-157 may be performed by the same device that performs steps 101-109 of FIG. 3 or by a different device.

The set of one or more devices that is controlled in step 157 of FIG. 4 is not necessarily the same as the set of one or more devices that is identified in step 103 of FIG. 3, e.g. if steps 151-157 of FIG. 4 are performed by a different device than steps 101-109 of FIG. 3. In this case, devices that are controlled to render the light (scene) according to the light settings may be of different types and/or located at different positions than identified devices.

The light settings/light scene may therefore identify or be associated with required/desired capabilities, e.g. color or white or minimum light output, and/or required/desired positions, e.g. "upper-right corner" or "left of television", similar to light settings specified in a light script, and lighting devices best matching these properties may be selected from a plurality of lighting devices in order to render the light (scene) according to these light settings.

Figure 5:
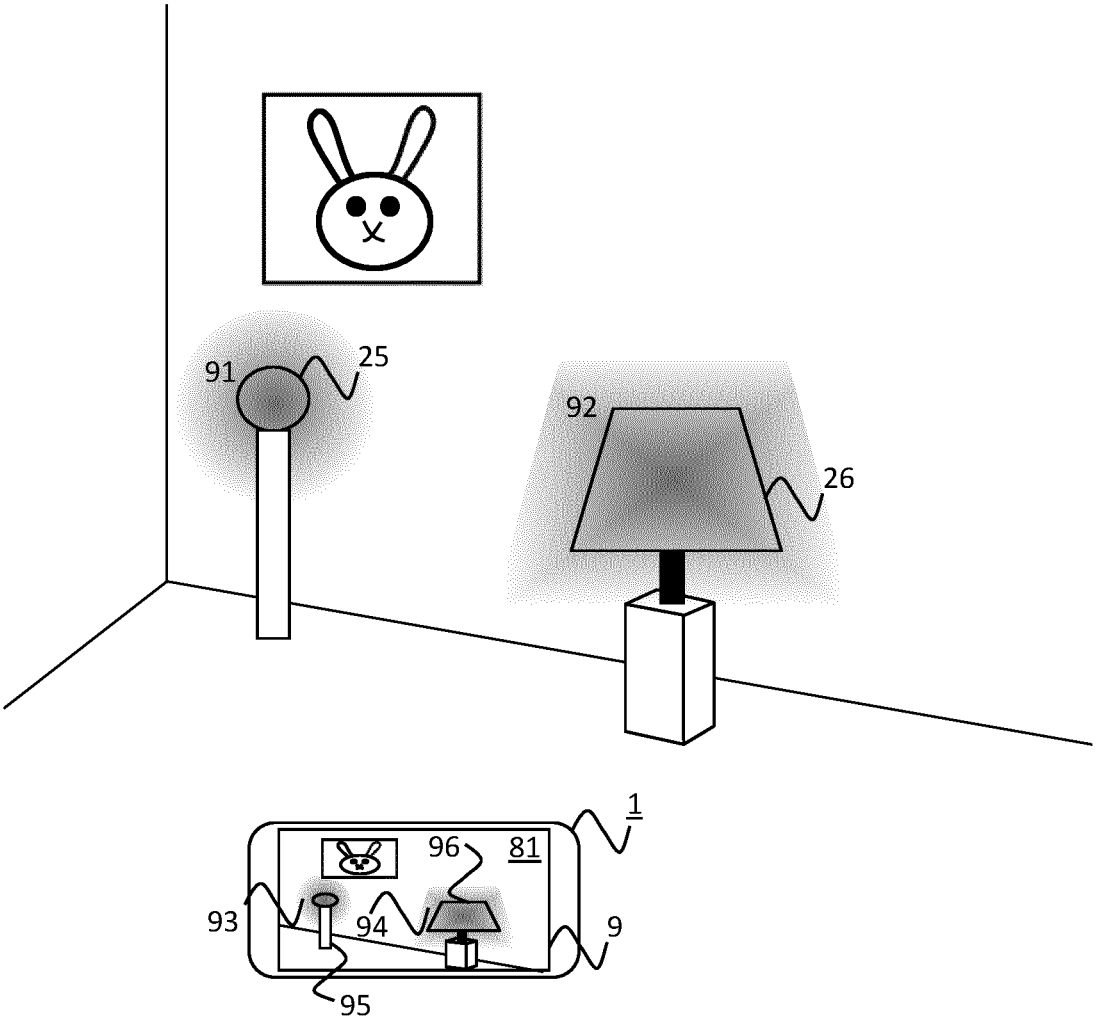
FIG. 5 shows an example of an image capturing light effects.

FIG. 5 shows an example of an image capturing light effects: image 81. In the example of FIG. 5, the mobile device 1 of FIG. 1 has captured the image 81 and displays the image 81 on its display 9. The image 81 captures a part of a room and in particular a lighting device 25 creating a light effect 91 and a lighting device 26 creating a light effect 92.

In a first implementation, only the lighting devices 25 and 26 are recognized, e.g. by recognizing the objects 95 and 96 corresponding to lighting devices 25 and 26, respectively, in the image 81. In a second implementation, only the lighting effects 91 and 92 are recognized, e.g. by detecting one or more codes in the regions/objects 93 and 94 corresponding to the light effects 91 and 92, respectively, or by recognizing the regions/objects 93 and 94 themselves in the image 81. In this case, the lighting devices 25 and 26 are identified based on the recognized light effects.

In a third implementation, both the lighting devices 25 and 26 and the light effects 91 and 92 are recognized. This is mostly beneficial if a light effect, but not the lighting device creating the light effect, is captured in the image. This is not the case in the example of FIG. 5.

Figure 6:
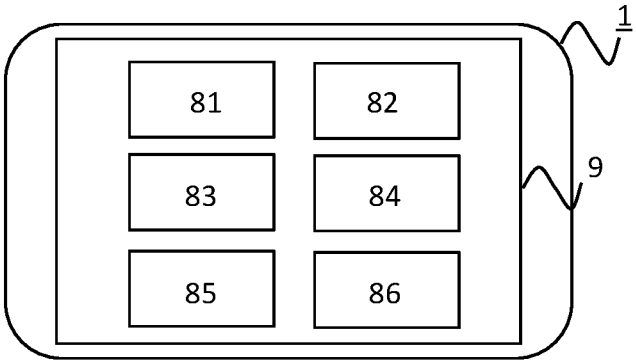
FIG. 6 shows an example of a user interface for activating a light scene by selecting a representative image.

FIG. 6 shows an example of a user interface for activating a light scene by selecting a representative image. In the example of FIG. 6, this user interface is displayed on display 9 of mobile device 1 of FIG. 1. This user interface may additionally or alternatively be displayed on display 19 of mobile device 11 of FIG. 1, on a display of mobile device 61 of FIG. 2 or on a display of mobile device 62 of FIG. 2, for example.

The user interface displays image 81 of FIG. 5 and five further images 82-86. Each of the images 81-86 represents a light scene and is associated with a set of one or more light settings. Alternatively, one or more of the images 81-86 may be replaced with a video to represent the corresponding light scene. In the example of FIG. 6, the display 9 is a touch-screen display and touching the area of the display 9 corresponding to an image activates the set of one or more light settings associated with the selected image, e.g. on the local lighting system and/or on a lighting system associated with the user.

Figure 7:
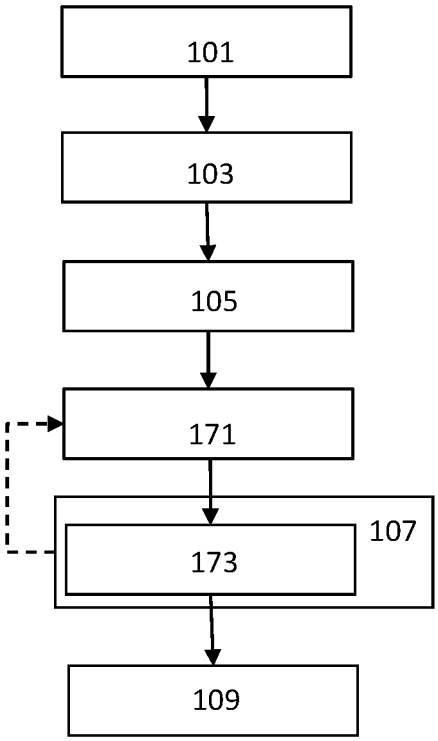
FIG. 7 is a flow diagram of a third embodiment of the method.

A third embodiment of the method is shown in FIG. 7. In this third embodiment, video is captured in step 101 of FIG. 3 and the light settings retrieved in step 105 of FIG. 3 include previous and/or next light settings. Steps 101-105 of FIG. 3 are followed by a step 171. Step 171 comprises selecting a plurality of images from the captured video by including a frame of the captured video in the plurality of images based on a level of changes between light settings captured in the frame and light settings captured in a preceding frame of the captured video. Thus, the plurality of images forms a condensed video.

In the embodiment of FIG. 7, step 107 of FIG. 3 comprises a sub step 173. Step 173 comprises associating at least one of the one or more light settings with a subset of the plurality of images. This at least one light setting may correspond to a static light effect, a dynamic light effect or a part of a dynamic light effect. Steps 171 and 173 may be repeated until all light settings that correspond to light effects captured in the video have been associated with a part of the condensed video. Next, step 109 is performed as described in relation to FIG. 3.

Figure 8:
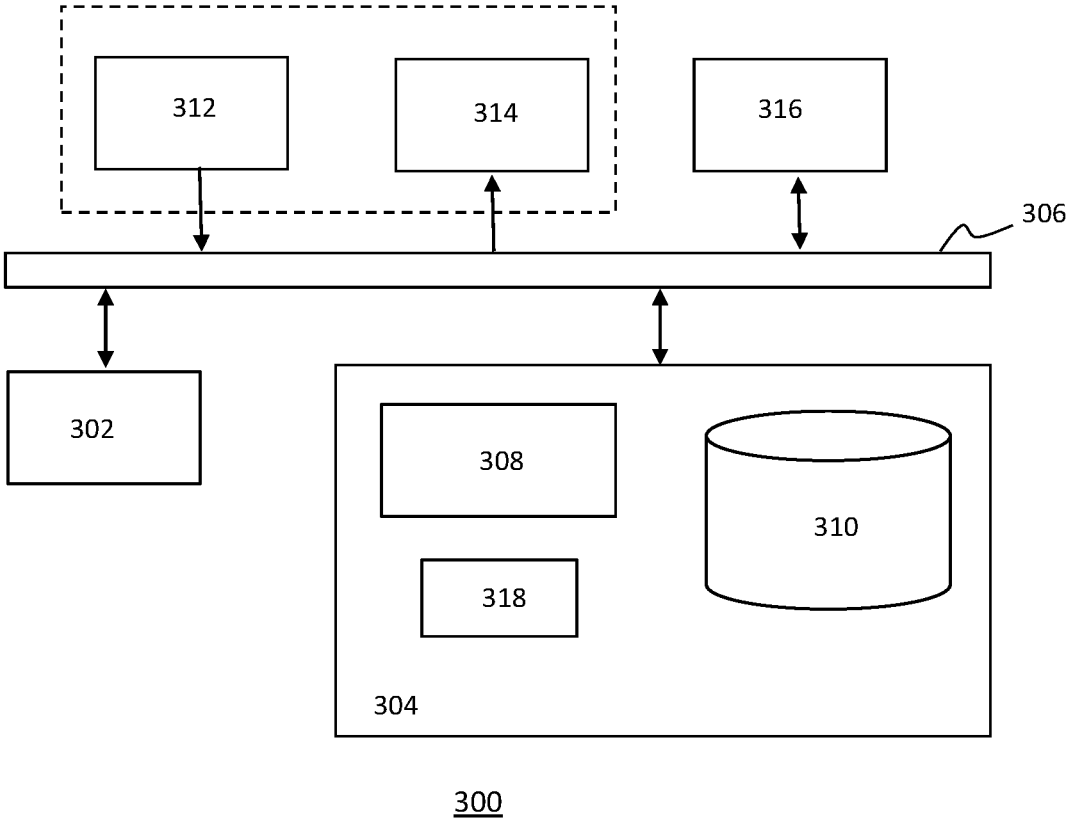
FIG. 8 is a block diagram of an exemplary data processing system for performing the method of the invention.

FIG. 8 depicts a block diagram illustrating an exemplary data processing system that may perform the method as described with reference to FIGS. 3, 4 and 7.

As shown in FIG. 8, the data processing system 300 may include at least one processor 302 coupled to memory elements 304 through a system bus 306. As such, the data processing system may store program code within memory elements 304. Further, the processor 302 may execute the program code accessed from the memory elements 304 via a system bus 306. In one aspect, the data processing system may be implemented as a computer that is suitable for storing and/or executing program code. It should be appreciated, however, that the data processing system 300 may be implemented in the form of any system including a processor and a memory that is capable of performing the functions described within this specification.

The memory elements 304 may include one or more physical memory devices such as, for example, local memory 308 and one or more bulk storage devices 310. The local memory may refer to random access memory or other non-persistent memory device(s) generally used during actual execution of the program code. A bulk storage device may be implemented as a hard drive or other persistent data storage device. The processing system 300 may also include one or more cache memories (not shown) that provide temporary storage of at least some program code in order to reduce the quantity of times program code must be retrieved from the bulk storage device 310 during execution. The processing system 300 may also be able to use memory elements of another processing system, e.g. if the processing system 300 is part of a cloud-computing platform.

Input/output (I/O) devices depicted as an input device 312 and an output device 314 optionally can be coupled to the data processing system. Examples of input devices may include, but are not limited to, a keyboard, a pointing device such as a mouse, a microphone (e.g. for voice and/or speech recognition), or the like. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 8 with a dashed line surrounding the input device 312 and the output device 314). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 316 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 300, and a data transmitter for transmitting data from the data processing system 300 to said systems, devices and/or networks. Modems, cable modems, and Ethernet cards are examples of different types of network adapter that may be used with the data processing system 300.

As pictured in FIG. 8, the memory elements 304 may store an application 318. In various embodiments, the application 318 may be stored in the local memory 308, the one or more bulk storage devices 310, or separate from the local memory and the bulk storage devices. It should be appreciated that the data processing system 300 may further execute an operating system (not shown in FIG. 8) that can facilitate execution of the application 318. The application 318, being implemented in the form of executable program code, can be executed by the data processing system 300, e.g., by the processor 302. Responsive to executing the application, the data processing system 300 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 302 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. An electronic device for outputting one or more light settings and an association between said one or more light settings and at least one image, said electronic device comprising:

at least one input interface;

at least one output interface; and at least one processor configured to:

use said at least one input interface to obtain at least one image captured with a camera, said at least one image capturing one or more light effects, identify one or more lighting devices which render said one or more light effects, use said at least one input interface to receive one or more input signals comprising one or more current light settings of said identified one or more lighting devices, and use said at least one output interface to output said one or more current light settings and an association between said one or more current light settings and said at least one image, wherein said at least one processor is configured to output said one or more current light settings as metadata of said at least one image and/or said at least one processor is configured to output said at least one image as metadata of said one or more current light settings.

2. An electronic device as claimed in claim 1, wherein said at least one processor is configured to:

use said at least one input interface to obtain said association, said one or more light settings, and said at least one image, use said at least one output interface to control a display to display said at least one image, use said at least one input interface to allow a user to select said at least one image, and use said at least one output interface to control at least one lighting device to render light according to said one or more light settings upon said selection.

3. An electronic device as claimed in claim 1, wherein said at least one processor is configured to use said at least one output interface to transmit a light setting signal which comprises said one or more current light settings and said association.

4. An electronic device as claimed in claim 1, wherein said at least one processor is configured to identify said one or more lighting devices by performing image analysis on said at least one image.

5. An electronic device as claimed in claim 4, wherein said at least one processor is configured to identify at least one of said one or more lighting devices by detecting one or more codes in said rendered one or more light effects and/or by recognizing said at least one of said one or more lighting devices in said at least one image using object recognition and/or by recognizing at least one of said one or more light effects in said at least one image using image analysis.

6. An electronic device as claimed in claim 1, wherein said at least one image comprises a plurality of images.

7. An electronic device as claimed in claim 6, said at least one processor is configured to select said plurality of images from a captured video, a frame of said captured video being included in said plurality of images based on a level of changes between light settings captured in said frame and light settings captured in a preceding frame of said captured video.

8. An electronic device as claimed in claim 6, wherein said association associates at least one of said one or more light settings with a subset of said plurality of images.

9. An electronic device as claimed in claim 1, wherein said at least one processor is configured to identify said one or more lighting devices by identifying at least one lighting device in a field of view said camera and/or at least one light effect in said field of view of said camera based on a spatial location and an orientation of said camera and at least one spatial location of said at least one lighting device and/or of at least one further lighting device rendering said at least one light effect.

10. An electronic device as claimed in claim 1, wherein said one or more input signals further comprise one or more previous light settings and/or one or more future light settings and said association associates said one or more previous light settings and/or said one or more future light settings with said at least one image.

11. A system comprising the electronic device of claim 1 and a further electronic device, said further electronic device comprising:

at least one input interface;

at least one output interface; and at least one processor configured to:

use said at least one input interface to receive a light setting signal which comprises one or more light settings and an association between said one or more current light settings and at least one image, use said at least one output interface to control a display to display said at least one image, use said at least one input interface to allow a user to select said at least one image, and use said at least one output interface to control at least one lighting device to render light according to said one or more light settings upon said selection.

12. A method of outputting one or more light settings and an association between said one or more light settings and at least one image, said method comprising:

obtaining at least one image captured with a camera, said at least one image capturing one or more light effects;

identifying one or more lighting devices which render said one or more light effects;

receiving one or more input signals comprising one or more current light settings of said identified one or more lighting devices; and outputting said one or more current light settings and an association between said one or more current light settings and said at least one image, outputting said one or more current light settings as metadata of said at least one image and/or outputting said at least one image as metadata of said one or more current light settings.

13. A method as claimed in claim 12, further comprising:

obtaining said association, said one or more light settings, and said at least one image;

controlling a display to display said at least one image;

allowing a user to select said at least one image; and controlling at least one lighting device to render light according to said one or more light settings upon said selection.

14. A non-transitory computer readable medium comprising at least one software code portion or a computer program product storing at least one software code portion, the software code portion, when run on a computer system, being configured for performing the method of claim 12.

* * * * *